US008069606B1

(12) United States Patent
Saur

(10) Patent No.: US 8,069,606 B1
(45) Date of Patent: Dec. 6, 2011

(54) FIREARM SELECTOR REMOVAL AND INSTALLATION TOOL

(75) Inventor: Thomas W. Saur, Dearborn, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 45 days.

(21) Appl. No.: 12/759,821

(22) Filed: Apr. 14, 2010

(51) Int. Cl.
*F41C 27/00* (2006.01)

(52) U.S. Cl. ..... 42/108; 81/430; 29/278; 29/280

(58) Field of Classification Search ..... 42/90, 108; 81/442, 443, 450; 29/270, 278, 271, 280
See application file for complete search history.

(56) References Cited

U.S. PATENT DOCUMENTS 2,749,953 A * 6/1956 Rundle ..... 81/490
5,505,571 A * 4/1996 Jakob ..... 408/124
* cited by examiner

*Primary Examiner* — Michael Carone
*Assistant Examiner* — Daniel Troy
(74) *Attorney, Agent, or Firm* — Michael C. Sachs

(57) ABSTRACT

This tool makes it possible to more conveniently handle the "selector" element on a conventional M16/M4 family weapon when the selector must be removed or reinserted. As will be appreciated by those in the gun repair trade, in the disassembly or reassembly of such weapons the handling of the selector element is a tricky and painstaking activity. This disclosed tool handily is an assist in such activities. The tool is inserted in the opening in the receiver of the selector element and rotated. An offset circular cam means on the tool when rotated will handily depress the detent element (which necessarily must be done and it also has a spring beneath it). A bumper end cap at the distal end of the tool will carefully engage the selector element to gently push on it if needed (or in the reverse operation for the tool to be gently backed away there from as the selector is repositioned into the weapon). A longitudinal groove on the cam means will signal to the user when the proper rotation has been achieved to adequately depress said detent element.

13 Claims, 4 Drawing Sheets

FIREARM SELECTOR REMOVAL AND INSTALLATION TOOL

U.S. GOVERNMENT INTEREST

The inventions described herein may be made, used, or licensed by or for the U.S. Government for U.S. Government purposes.

BACKGROUND AND SUMMARY OF INVENTION

This tool makes it possible to more conveniently handle the "selector" and other allied elements on a conventional M16/M4 family weapon when the selector and/or other elements need to be removed or reinserted. As will be appreciated by those in the gun repair trade, in the disassembly or reassembly of such weapons the handling of the selector and allied elements is a tricky and painstaking activity, greatly needing improved assist. This disclosed tool handily is a great addition and assist in such activities.

The description as follows includes directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user. The description assumes the level of knowledge held by an ordinary armorer, gunsmith, repair or assembly technician, maintenance personnel, and the like for a conventional AR-15/M16 pattern rifle and M4 pattern carbine, and variants thereof, and the respective components and operation thereof.

During assembly and repair operations of AR-15/M16 pattern (style or family) rifles and M4 pattern (style or family) carbines (i.e., weapons), and variants thereof (referred to as "guns", "weapons" or "firearms" hereafter), the fire control group (i.e., mechanism, assembly, etc.) of such weapons, e.g., hammer, trigger, disconnector (or intermediate sear), selector (i.e., safety selector, safety, or control member), auto sear for selective fire weapons, associated springs and pins, as is well known to those skilled in the art of the assembly, maintenance, and repair the weapons of the are often removed and installed (or reinstalled). U.S. Pat. Nos. 3,045,555 and 5,760,328 describe examples of the fire control components of the conventional M16 rifle.

Operations that require the removal and installation of the fire control group (FCG) components of the weapon, in particular the trigger, disconnector and disconnector spring subassembly (i.e., trigger subassembly), is problematic because the selector obstructs ready access to the trigger subassembly. Many repair and maintenance instructions recommend removal of the selector to provide the desired access to the trigger subassembly. However, the selector is retained via a selector detent and spring that are in the firearm lower receiver and which are retained by the firearm hand grip which is, in turn, retained by a screw inside the grip. The grip retention screw fastens into the lower receiver.

Unfortunately, the removal of the grip screw and grip, and selector detent and selector detent spring has a number of deficiencies. Such deficiencies include (i) the process is time consuming; (ii) there is risk of loss of components, especially loss of the relatively small selector, detent and selector detent spring; (iii) usually requires repositioning the lower receiver; (iv) risks stripping the grip screw threads in the lower receiver which generally ruins or requires expensive repair to the lower receiver; and (vi) when a Allen head grip screw is used to retain the grip as is common in some commercial weapons, requires a special, long reach Allen wrench which is often an additional expense.

Because of such deficiencies, a number of alternative conventional approaches have been implemented to remove and reinstall the selector without removing the grip (and the selector detent and selector detent spring). Selector removal can be performed by cocking the hammer or otherwise depressing the rear of the trigger and rotating the selector to a position intermediate to the 'safe' and 'fire' (or 'semi') detent hole locations, and then pressing the selector out (that is, to the left). The step of pressing the selector out is generally aided by the use of a non-scratching, cylindrically shaped tool having a diameter less than the diameter of the selector such as a wooden or plastic dowel, a push tool (for example, a pin push tool as shown in FIG. 1), or the like. Re-installation of the selector with the detent still in place is; however, typically more problematic. Conventional alternatives to reinstall the selector, with the respective deficiencies, have been used with limited success.

One conventional approach to reinstall the selector is to depress the detent with an appropriately sized flat blade screwdriver (or a round punch) with one hand, and with the other hand, the selector is held rotated intermediate to the 'safe' and 'fire' detent hole locations and slid to the right and back into place. Such a procedure has the deficiencies of (i) the detent is typically pointed and thus difficult to properly depress with the screwdriver blade or punch end which slips off the detent point; (ii) the detent spring is strong and so the detent is difficult to hold down; (iii) there is risk of scratching the selector or the lower receiver finish with the screwdriver blade or punch end; (iv) the lower receiver obstructs the view of the detent; and (v) the technique requires some degree of coordination, dexterity, skill and practice as there is difficulty maneuvering the screwdriver or punch and manipulating the selector in different directions and with different movements simultaneously.

Another conventional approach is to depress the detent with an appropriately sized slanted end tool similar to a tool that is sometimes used to install the firearm pivot pin detent; rotating the tool; and sliding the selector back in place. However, such a tool has does not have lateral support as does a front pivot pin detent tool, and hence, has similar deficiencies to the procedure of using a screwdriver or punch noted above.

Yet another conventional approach is to rotate the selector intermediate to the 'safe' and 'fire' (or 'semi') detent hole locations, and attempt to rapidly slide and wiggle the selector to the right and back into place. Such attempts generally only result in damage to the selector and/or the detent, and failure to reinstall the selector as selectors typically do not have a sufficiently and appropriately beveled edge to adequately depress the detent to provide for reinstallation.

BRIEF DESCRIPTION OF THE INVENTION

The description herein assumes the level of knowledge held by an ordinary armorer, gunsmith, repair or assembly technician, maintenance personnel, and the like for a conventional AR-15/M16 pattern rifle and M4 pattern carbine, and variants thereof, and the respective components and operation thereof. The description may include directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user.

For ease of description and explanation, U.S. Pat. No. 3,045,555, issued Jul. 24, 1962 to E. M. Stoner, titled "Automatic trigger mechanism with three sears and a rotatable control member", (the '555 patent) is hereby incorporated by reference in its entirety. As is known to one of ordinary skill in the art, the '555 patent illustrates and describes the fire control mechanism of the conventional M16 pattern rifle and/or M4 pattern carbine. The conventional AR-15 rifle implements a simplified (i.e., semi-automatic fire) version of the fire control mechanism of the '555 patent. In particular, referring to the '555 patent on FIGS. 2 and 3 and at col. 3, line 20 through col. 4, line 41, the physical layout and operation of the relevant components of the firearm fire control mechanism is illustrated and described. The numbering of elements of the '555 patent (i.e., elements having numbers below 200) are implemented for description of the environment which is described herein. The environment forms no part of the invention.

The description as follows is directed to a firearm selector removal and installation tool 200 (wherein elements of the tool 200 are numbered 200 and above), and includes directional designations such as up, down, left, right, lateral, transverse, longitudinal, top, bottom, vertical, and the like, that are generally taken from the perspective of a firearm (gun, weapon, and the like, e.g., a conventional AR-10/AR-15/M16/M4 family, style, platform, or pattern rifle and carbine, and variants thereof as designated element 10 in the '555 patent) as typically held and operated (e.g., fired).

The description is generally related to and made in connection with the fire control group (FCG) (i.e., mechanism, assembly, etc.) of such weapons, e.g., hammer 62, trigger 50, disconnector (intermediate sear) 68, selector (common control member, rotatable control member, safety selector, safety) numbered as 120 in the'555 patent, auto sear 96 for selective fire weapons, and associated springs and pins of AR-15/M16 pattern (platform, style, or family) rifles and M4 pattern carbines (i.e., weapons), and variants thereof (referred to as "guns", "weapons" or "firearms" hereafter). The selector generally rotatably controls the mode of operation (e.g., safe, semiautomatic, burst, or full automatic fire) of the gun 10. The description is generally applicable to removal and installation of the selector, and the installation tool 200 may be advantageously implemented in connection with, other firearms having the same or similar FCGs.

DETAILED DESCRIPTION

Figure 1:
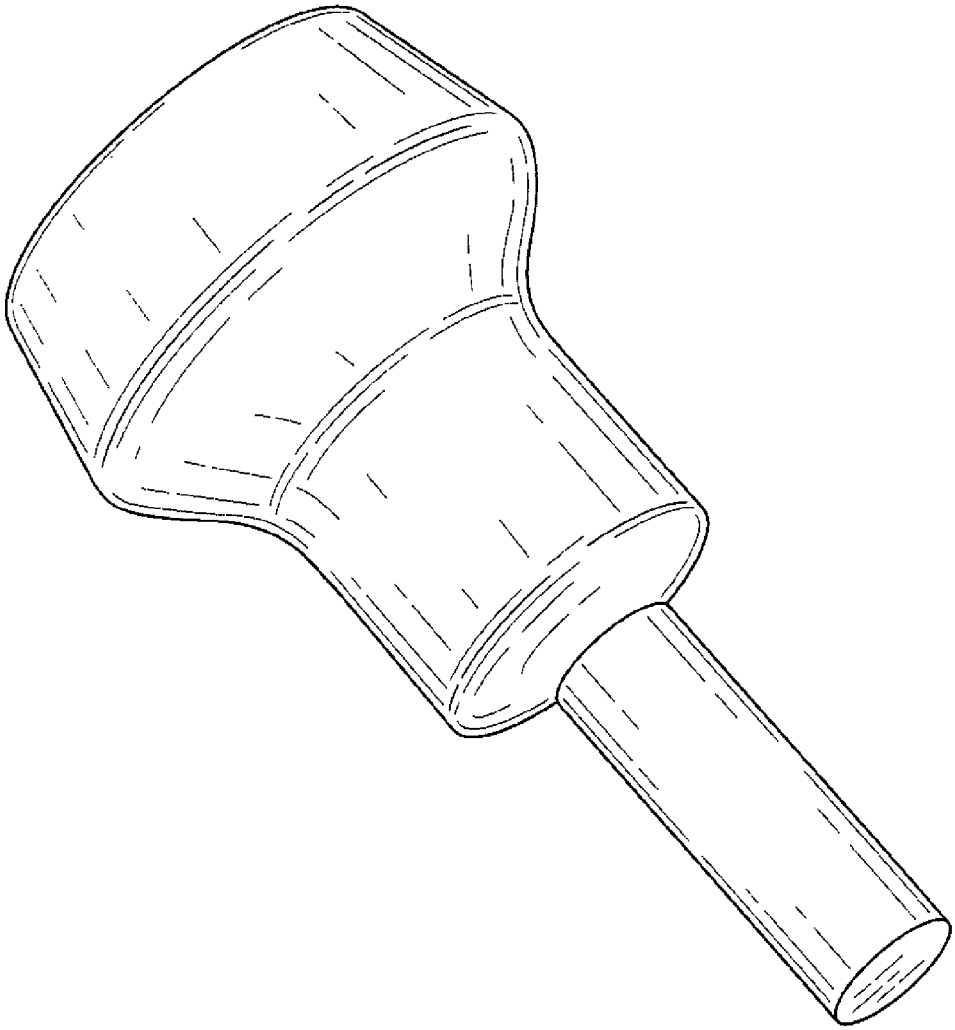
FIG. 1 PRIOR ART
FIG. 1 illustrates a conventional, prior art AR-15/M16 rifle and M4 carbine pin push tool.
Figure 2:
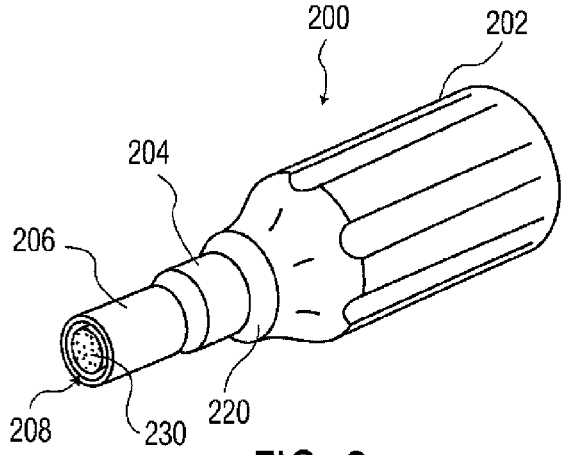
FIG. 2 is an isometric view of a firearm selector removal and installation tool of the present invention.

FIG. 1 illustrates a conventional, prior art AR-15/M16 rifle and M4 carbine pin push tool; Referring to FIG. 2, an isometric view of the firearm selector removal and installation (or insertion) tool (i.e., apparatus, device, unit, etc.) 200 is shown. The tool 200 is generally implemented in connection with removal and installation of the selector of a conventional AR-15/M16 pattern rifle and/or M4 pattern carbine 10, and variants thereof (i.e., firearm, weapon, etc.) having a lower receiver (e.g., the receiver 14). The selector is mounted within the receiver 14 in two circular apertures (openings, holes) that are laterally situated across from each other in the left and right sides of the receiver 14 (see, for example, the '555 patent on FIG. 3). The end of the selector having control handle 122 is mounted in the left side of the receiver 14 and the end of the selector having control cam 124 is mounted in the right side of the receiver 14. The firearm tool 200 is generally used by a user such as an armorer, gunsmith, repair or assembly technician, maintenance personnel, and the like.

The tool 200 has a generally screwdriver like shape. The tool 200 generally comprises a handle 202, a support shaft 204, a detent cam 206 having a groove 208, a collar 220, and a bumper 230. The tool 200 has a first end (handle 202 end) and a second end (cam 206 end). The handle 202, the support shaft 204, and the detent cam 206 are a generally longitudinal, integral unit 200.

The handle 202 generally includes longitudinal grooves and/or swells, stippling, and the like to aid user gripping and twisting the tool 200. The handle 202 is generally made of a tough, durable plastic such as nylon or urethane. In alternate embodiments, materials such as wood or metal may be implemented.

The support shaft 204 is generally integral to the handle 202, and the support shaft 204 is generally coaxial with the handle 202. The support shaft 204 is typically made of tough, durable plastic. The support shaft 204 may be molded integral with or inserted into the handle 202.

The detent cam 206 is generally made of steel or a similar strong, hard metallic substance. The cam 206 is generally molded integral into or inserted into the support shaft 204 and handle 202.

The collar 220 (described in further detail in connection with FIGS. 6-8) may be ring shaped, and generally fits snugly but rotatably around the shaft 204. The collar 220 is typically made of tough, durable plastic.

The bumper 230 (described in further detail in connection with FIGS. 5 and 6) is generally installed into the outer end of the cam 206. The bumper 230 is typically made of tough, durable plastic.

Figure 3:
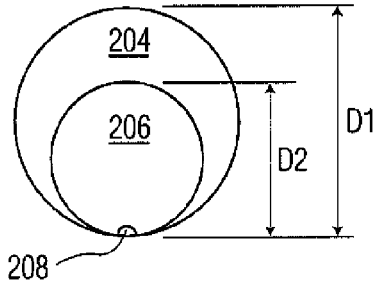
FIG. 3 is a simplified end view that illustrates some relative dimensions and positions of elements of the tool of FIG. 2.

Referring to FIG. 3, a simplified end view of the second end of the tool 200 illustrates the spatial relationship of the shaft 204 and the cam 206. The shaft 204 has a diameter, D1, and the cam 206 has a diameter, D2, that is smaller than the diameter D1. The cam 206 is offset relative to the shaft 204 such that the outer circumference edge of the cam 206 containing the groove 208 coincides with the outer circumference edge of the shaft 204.

Figure 4:
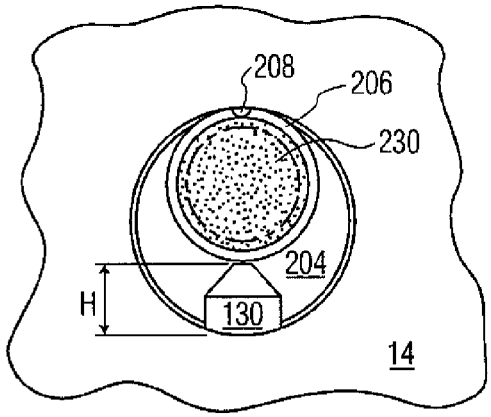
FIG. 4 is a broken view of a portion of the right side a firearm receiver from the inside looking left that illustrates the tool of FIG. 2 as installed during the selector installation process prior to rotation of the tool.

Referring to FIG. 4, a broken view of a portion of the right side of the firearm receiver 14 from the inside looking left illustrates the tool 200 as installed during the selector installation process prior to rotation (twisting) of the tool 200. When the selector is not mounted in the right side of the receiver 14, the detent 130 is biased upward by spring 132

(seen in FIG. 5 and FIG. 6) to a protrusion (or extended) height, H. When protruded, the safety detent 130 generally prevents installation of the selector 120. As such, the detent 130 should be depressed to enable the installation of the selector 120.

The diameter of the support shaft 204, D1, is selected such that the shaft 204 fits snugly but rotatably in the hole in the receiver 14 for the end of the selector that contains the control cam 124 when the selector is mounted in the receiver 14 (i.e., the diameter, D1, may be about the same diameter as the diameter of the ends of the selector). The diameter of the detent cam 206, D2, is selected to provide clearance to the protrusion (i.e., extended) height, H, of the detent 130 such that, with the cam 206 at the top, the cam 206 may be inserted into the receiver 14 (generally from right to left). When the tool 200 is inserted into the receiver 14, the groove 208 is generally at or near the top. During the selector installation operation, after insertion into the receiver 14, the tool 200 may be rotated either clockwise or counter-clockwise to depress the detent 130 via camming action of the outer radial surface of the detent cam 206 and, thereby, enable insertion of the selector (from left to right).

Figure 5:
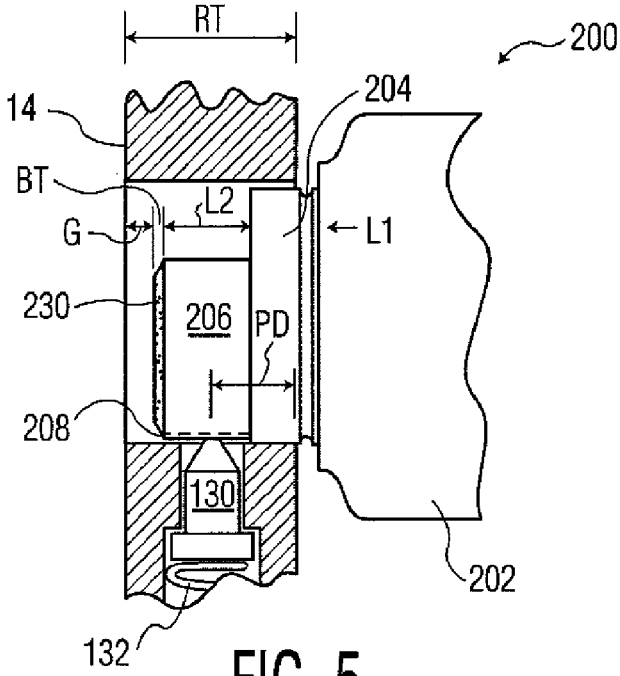
FIG. 5 is a partial sectional view of the right side of the firearm receiver from the rear that illustrates the tool of FIG. 2 during the selector installation process after rotation of the tool.

Referring to FIG. 5, a partial sectional view of the right side of the firearm receiver 14 from the rear illustrates the tool 200 during the selector installation process after rotation of the tool 200. The receiver 14 has a thickness, RT; and the detent 130 has a point that is inward from the right outside surface of the receiver 14 at an inward offset, PD. The shaft 204 extends from the handle 202 at a length, L1; and the cam 206 extends from the shaft 204 at a length, L2. The top (or head) of the bumper 230 has a thickness, BT.

The dimensions of the elements that comprise the tool 200 are selected (e.g., calculated, determined, chosen, and the like) such that when the tool 200 is inserted into the receiver 14, rotation of the tool 200 will depress the detent 130 such that the selector may be readily inserted (generally from the left to the right) into the receiver 14. In particular, the length L1 is generally selected such that the support shaft 204 remains within the outer wall of the receiver 14 (i.e., to the right of the hole that contains the detent 130). The length L2 is generally selected such that the cam 206 extends inward beyond the point offset, PD, and, preferably but not necessarily, beyond the inner edge of the hole that contains the detent 130. However, the sum of the lengths L1 plus L2 plus the outer thickness of the bumper 230, BT, is less than the thickness RT such that a gap, G, that provides clearance such that the control cam 124 end of the selector may readily be guided (piloted) into the respective mounting hole in the receiver 14.

The groove 208 generally has a depth that is selected to provide the user with a tactile and audible click when the point of the detent 130 is engaged into the groove 208 during rotation of the tool 200 while depressing the detent 130 sufficiently to enable the selector to be readily inserted into the right wall of the receiver 14. The diameter of the bumper 230 is selected such that the outer circumference of the bumper 230 is slightly inside the groove 208.

Figure 6:
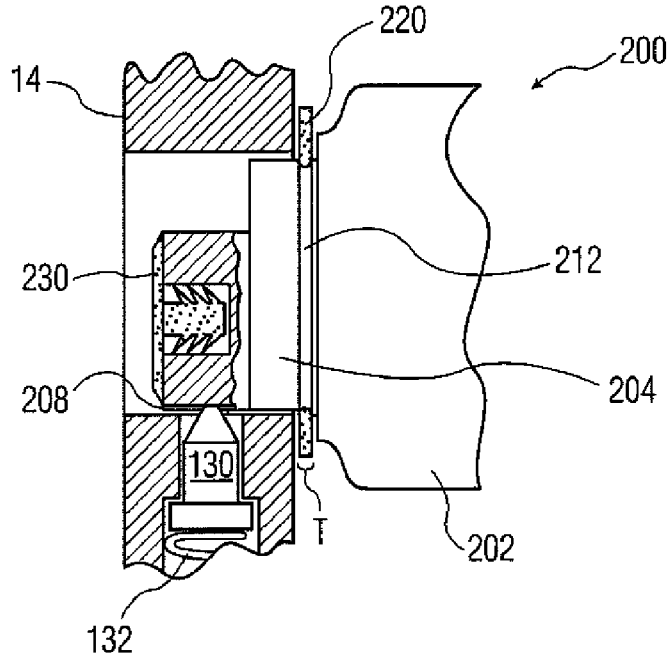
FIG. 6 is a partial sectional view of the right side of the firearm receiver from the rear that illustrates the tool of FIG. 2 during the selector installation process after rotation of the tool, and also illustrates further details of the tool.

Referring to FIG. 6, another partial sectional view of the right side of the firearm receiver 14 from the rear illustrates further details of the tool 200. The collar 220 has a thickness, T, and the collar 220 is snugly but rotatably mounted in a circumferential groove 212 in the shaft 204. The bumper 230 generally comprises a head section that is at the outer end of the detent cam 206 and a push-in retainer section having a generally cylindrical stem with multiple layers of flexible radial fins thereon (typically called in the art a "Christmas-tree" retainer).

During a process to remove the selector, the head section of the bumper 230 may be advantageous implemented as a push tool and operated similarly to a conventional push tool. During a process to install the selector, the selector is held at a position between "safe" and "fire" and is pushed left to right, and the selector ejects the tool 200. The head section of the bumper 230 generally provides reduction or elimination of damage to the finish of the outer right end of the selector during removal and installation processes. The "Christmas-tree" section of the bumper 230 may be installed in a respective appropriately sized hole in the cam 206. The hole in the cam 206 is generally threaded to aid retention of the bumper 230 in the cam 206.

Figure 7:
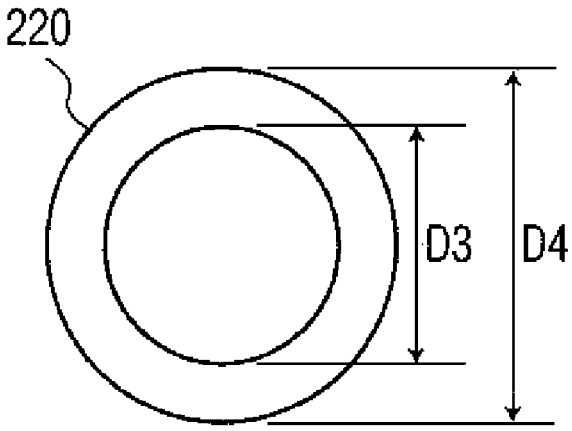
FIG. 7 is an end view of a collar that comprises a component of the tool of FIG. 2.

FIG. 7 is an end view of the collar 220. The collar 220 generally has a flat ring shape. Referring to FIGS. 6 and 7 simultaneously, the collar 220 has an inner diameter, D3, and an outer diameter, D4. The thickness T and the diameter D3 are selected to provide the snug but rotatable fit to the groove 212 on the shaft 204 as noted. The diameter D4 is sized such that the collar 220 extends radially outward past the shoulder of the handle 202. When the tool 200 is inserted in the receiver 14, the collar 220 generally is stationary against the outer wall of the receiver 14 when the tool 200 is rotated. As such, the collar 220 may reduce or prevent friction against and damage to the finish of the outer surface of the receiver 14.

Figure 8:
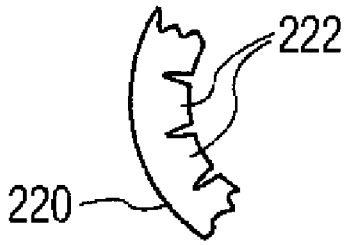
FIG. 8 is a broken side view of an alternative embodiment of the collar of FIG. 7.

Referring to FIG. 8, a broken side view of an alternative embodiment of the collar 220 is illustrated. To aid installation onto the shaft 204 and rotatability when the tool 200 is operated, the collar 220 may include a plurality of scallops (flaps, petals) 222 on the inner edge.

To summarize operation of the tool 200, during the removal of the selector, the tool 200 is implemented somewhat similarly to a conventional punch or push tool. The selector is rotated to a position intermediate to (between) the "safe" and "fire" positions; the bumper 230 is placed against the right end of the selector; and the tool 200 is firmly and rapidly pushed from right to left to eject the selector.

To install the selector, the tool 200 fully is inserted into the selector hole from the outside into the right side of the receiver 14, right to left, with the cam 206 at the top (e.g., as illustrated in FIG. 4); the tool 200 is rotated either clockwise or counter-clockwise and the radial outer surface of the detent cam 206 depresses the detent 130 until the detent 130 clicks into the groove 208; the selector is held at a position between the "safe" and "fire" positions and inserted through the left side of the receiver 14 across and into the right side of the receiver 14; via piloting provided by the gap, G, the selector is aligned with the bumper 230; the selector is firmly and rapidly pushed to the right against the bumper 230; and the tool 200 is ejected as the selector slides into place (and is held in place by the detent 130).

While the invention may have been described with reference to certain embodiments, numerous changes, alterations and modifications to the described embodiments are possible without departing from the spirit and scope of the invention as defined in the appended claims, and equivalents thereof.

The invention claimed is:

1. A tool for more convenient handling of the selector element of a rifle during disassembly and reassembly of the rifle, said tool comprising:

a handle means longitudinally attached to a support shaft means having a generally cylindrical outer shape with a diameter; a detent cam means having a generally cylindrical outer shape, and having a longitudinal groove thereon, said detent cam means being hollow at least at its distal end, said detent cam means having an outermost diameter that is smaller than the diameter of the support shaft means, and longitudinally attached off axis relative to the support shaft means such that the outer circumference edge of the detent cam means containing the longitudinal groove coincides with the outer circumference edge of the support shaft means;

a ring shaped collar means positioned snugly but rotatably around the support shaft means; and a bumper end cap means installed into the outer end of the detent cam means.

2. The tool of claim 1 wherein the handle means, support shaft means, ring shaped collar means and bumper end cap means, are made of a tough, durable plastic selected from the group of nylon or urethane.

3. The tool of claim 2 wherein the detent cam means is made of a hard metallic substance.

4. The tool of claim 3 wherein the detent cam means is made of steel.

5. The tool of claim 3 wherein the handle means, support shaft means and detent cam means are molded integrally as one unit.

6. The tool of claim 1 wherein the handle means is made of a material selected from the group of: nylon, urethane, wood or metal.

7. The tool of claim 6 wherein the handle means includes longitudinal grooves thereon.

8. The tool of claim 6 wherein the handle means includes longitudinal swells thereon.

9. The tool of claim 6 wherein the handle means includes longitudinal stippling thereon.

10. The tool of claim 1 wherein the support shaft is generally coaxial with the handle means.

11. The tool of claim 1 wherein the ring shaped collar includes a plurality of scallops on its inner edge.

12. The tool of claim 1 wherein the ring shaped collar includes a plurality of flaps on its inner edge.

13. The tool of claim 1 wherein the ring shaped collar includes a plurality of petals on its inner edge.

* * * * *